US005725112A

United States Patent [19]

Thorby

[11] Patent Number: 5,725,112

[45] Date of Patent: Mar. 10, 1998

[54] CRANE

[76] Inventor: Donald Frederick Thorby, Burrawong Park, Binnaway, New South Wales 2395, Australia

[21] Appl. No.: 617,181

[22] Filed: Mar. 18, 1996

Related U.S. Application Data

[63] Continuation of Ser. No. 244,848, filed as PCT/AU92/00666, Dec. 16, 1992, abandoned.

[30] Foreign Application Priority Data

Dec. 17, 1991 [AU] Australia ..... PL 0049

[51] Int. Cl.[6] ..... B66C 23/44

[52] U.S. Cl. ..... 212/180; 212/299; 212/238

[58] Field of Search ..... 414/545; 212/179, 212/180, 238, 261, 294, 297, 299, 300, 901

[56] References Cited

U.S. PATENT DOCUMENTS

| | | | |
|---|---|---|---|
| 2,305,202 | 12/1942 | Smith | 212/179 |
| 3,326,391 | 6/1967 | Adolfsson | 212/261 |
| 3,608,742 | 9/1971 | Adolfsson et al. | 212/238 |
| 4,069,922 | 1/1978 | Hawkins | 414/543 |
| 4,925,039 | 5/1990 | Macris | 212/901 |
| 5,211,297 | 5/1993 | Vandervalk | 212/901 |

FOREIGN PATENT DOCUMENTS

| | | | |
|---|---|---|---|
| 2459727 | 6/1975 | Germany | 212/238 |

*Primary Examiner*—Thomas J. Brahan
*Attorney, Agent, or Firm*—Ladas & Parry

[57] ABSTRACT

A portable crane for use on a pickup or utility truck is disclosed. The crane has a mounting base rotatably mountable to a tray of the motor vehicle. The crane includes a post connectable to a base frame which is welded to the mounting base. A lifting arm and a brace are telescopically arranged for different use configurations. The post, the brace and the lifting arm are able to be folded together to be substantially parallel when the crane is in its folded configuration.

8 Claims, 3 Drawing Sheets

CRANE

This is a continuation of application Ser. No. 08/244,848 filed on Sep. 14, 1994, now abandoned, which is a 371 of International Application PCT/AU92/00666 filed on Dec. 16, 1992 and which designated the U.S.

The present invention relates to cranes and, in particular, to a portable crane for use on a motor vehicle.

BACKGROUND OF THE INVENTION

When using a small pickup truck or utility truck it is often the case that heavy loads are lifted onto and from the tray of the truck is therefore desirable to have a small portable crane which is able to be mounted on the tray of the truck to do the lifting.

OBJECT OF THE INVENTION

It is an object of the present invention to provide an improved crane which is is to be used on a motor vehicle.

DISCLOSURE OF THE INVENTION

According to one aspect of the present invention there is disclosed a crane comprising a mounting base rotatably mountable to a tray of a motor vehicle, a base frame member attachable to said mounting base and which extends substantially parallel to said tray, a post which connects at one end to said base frame member and which extends substantially perpendicularly from said base frame member, a lifting arm which pivotally connects to other end of said post, and a brace which extends between said mounting base and said lifting arm, wherein said crane is able to be folded from a use configuration to a folded configuration so that said post, said brace and said lifting arm are substantially parallel when said crane is in said folded configuration.

BRIEF DESCRIPTION OF THE DRAWINGS

One embodiment of the present invention will now be described with reference to the drawings in which.

BEST MODE OF CARRYING OUT THE INVENTION

Figure 1:
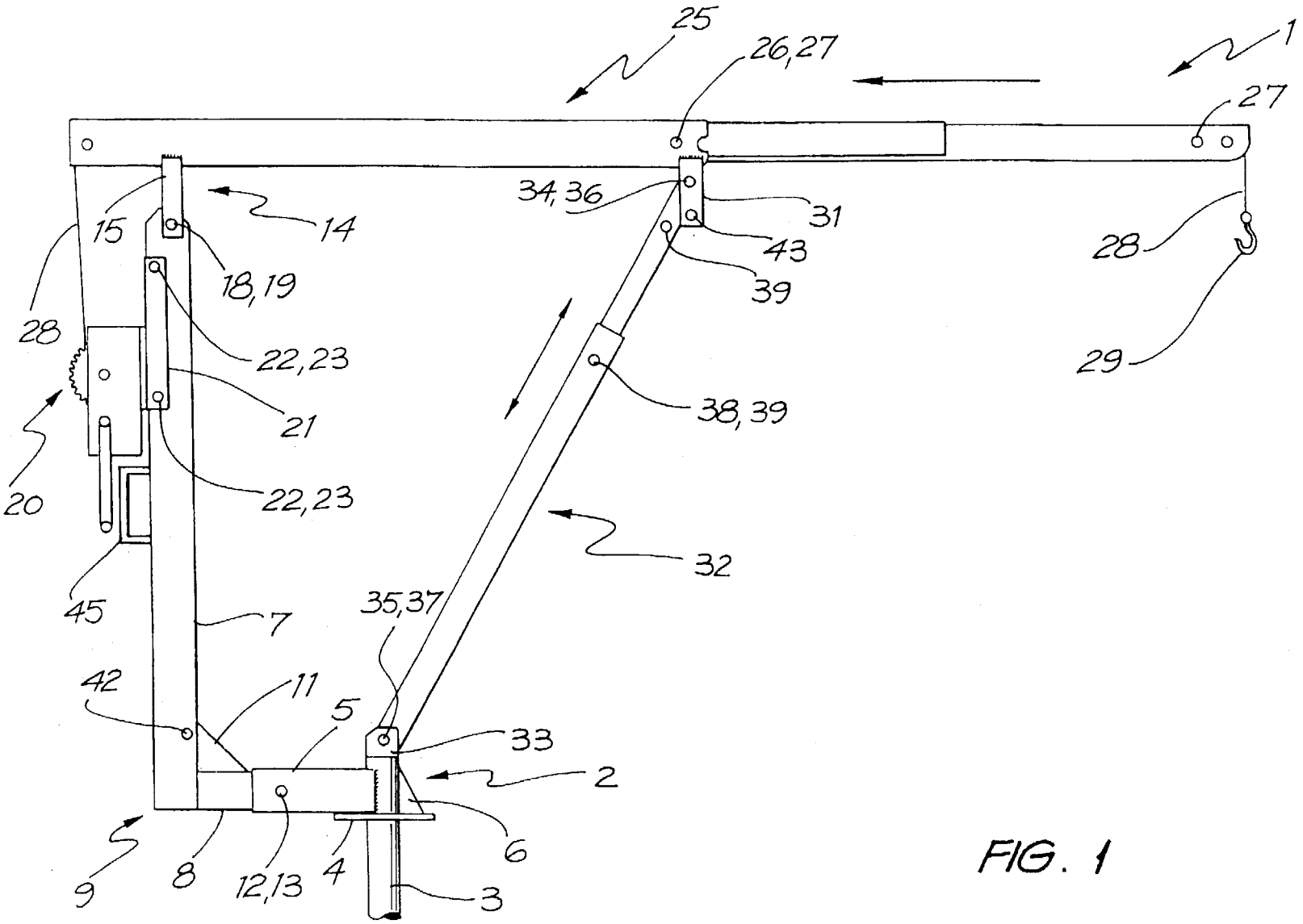
FIG. 1 is a side view of a crane of a preferred embodiment illustrated in one operating configuration.
Figure 2:
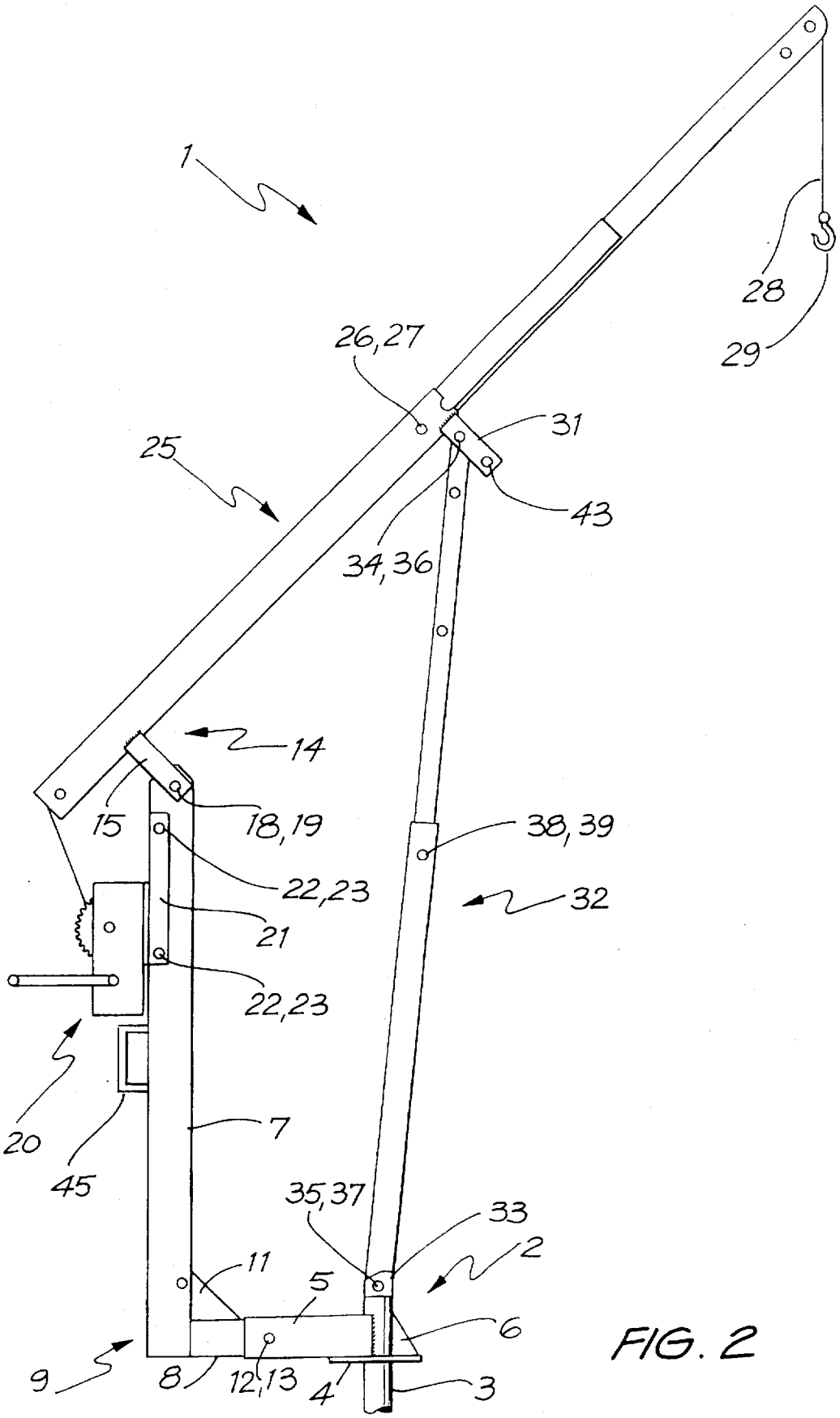
FIG. 2 is a side view of the crane of FIG. 1 illustrated in another operating configuration.

The crane 1 is shown as erected in FIGS. 1 and 2. The crane 1 includes a mounting base 2 which is rotatably mounted into a recess on the tray of a motor vehicle (not illustrated) such as a pickup truck or the like. The mounting base 2 includes a round pipe 3 and a circular flange 4. The round pipe 3 fits within the recess with the circular flange 4 resting on the tray of the motor vehicle.

Protruding perpendicularly to the pipe 3 is a rectangular hollow section tube (RHS) of a base frame 5. The base frame 5 is welded to the pipe 3, and a bracing triangular plate 6 is welded on the opposite side to provide strength.

A RHS post 7 has a RHS perpendicular connecting member 8 welded to its lower end 9. Another bracing triangular plate 11 is welded at the connection to provide strength. The RHS tube of the connecting member 8 is received within the RHS tube of the base frame 5 and a pin 12 is inserted into holes 13 to secure the connecting member 8 and base frame 5 together.

The post 7 has at its upper end 14 a pair of connecting strips 15. The connecting strips 15 are pivotally connected to the upper end 17 of the post 7 by a pin 18 which is inserted into holes 19. A winch 20 is attached to a mounting bracket 21 which is mounted on the post 7 via pins 22 which pass through corresponding holes 23 an the post 7. The mounting bracket 21 is pivotal about the top pin 22.

A RHS lifting arm 25 is pivotally connected to the post 7 by the connecting strips 15. The connecting strips 15 are welded to both sides of the lifting arm 25 adjacent one end of the lifting arm 25. As illustrated in the drawings, the lifting arm 25 comprises three sections which are telescopically received within each other. Pins 26 are used through holes 27 to provide the actual configuration for use and non-use. A wire rope 28 from the winch 20 passes up from the winch 20, through the interior of the telescopic lifting arm 25, and has,a hook 29 at its end.

Another pair of connecting strips 31 are welded to the sides of the outside one of the sections of the telescopic lifting arm 25. A RHS telescopic brace 32 is connectable between the connecting strips 31 and another pair of connecting strips 33 which are welded on the top of the mounting base 2. The brace 32 is pivotable through pins 34, 35 which pass through holes 36, 37 on the connecting strips 31 and 33 respectively. A pin 38 passing through holes 39 in the telescopic brace 32 sets the length of the brace 32 for each particular configuration.

The crane 1 is illustrated in two use configurations in FIGS. 1 and 2. The connecting member 8 is received within the base frame 5 and the post 7 is erected with the winch 20 located on the mounting bracket 21. In the configuration as illustrated in FIG. 1, the lifting arm 25 is horizontal and telescopically extended. The brace 32 is set by the pins 38. The crane 1 is rotatable about the axis of the pipe 3 and therefore is able to turn to load or unload the tray of the motor vehicle on which the crane 1 is erected.

In the configuration as illustrated in FIG. 2, the lifting arm 25 is shown at an angle of approximately 45° to the horizontal. The lifting arm 25 has been pivotted about the pins 18 which pass through the holes 19 in the connecting strips 15 and the post 7. For this operating configuration, the brace 32 is extended using the pins 38, with the two sections of the brace 32 are telescopically extended. The configuration as illustrated in FIG. 2 is to be used for larger items and for different lifting procedures.

Figure 3:
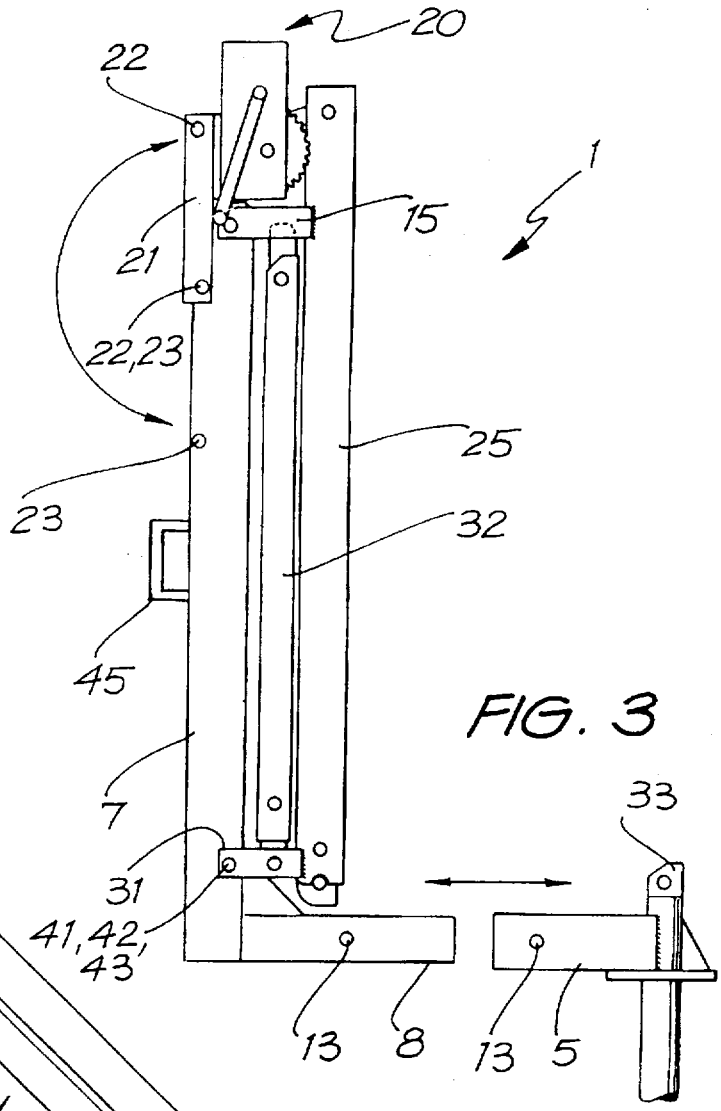
FIG. 3 is a side view of the crane of FIG. 1 illustrated in a folded configuration.
Figure 4:
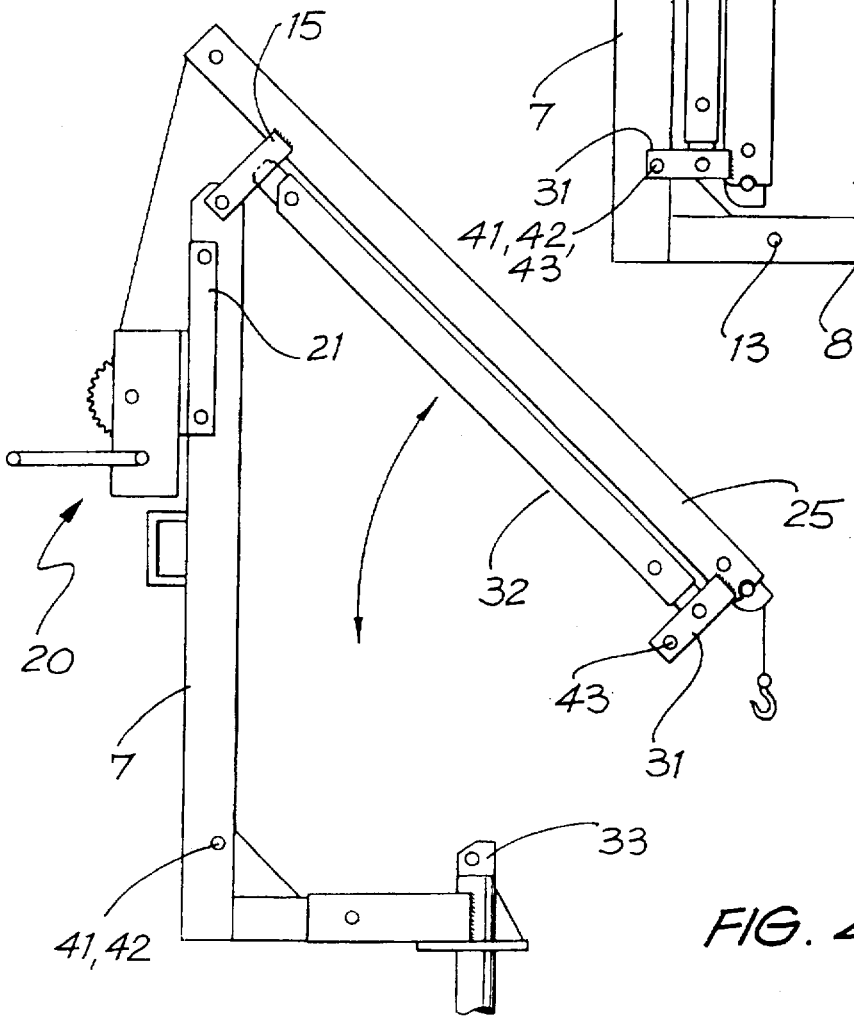
FIG. 4 is a side view of the crane of FIG. 1 illustrated in an intermediate stage of the folding procedure.

When the crane 1 is no longer required for use, it is folded to the folded configuration as illustrated in FIG. 3. To accomplish this configuration, the telescopic lifting arm 25 is shortened to its shortest length as illustrated in FIG. 4. The pins 26 are used to secure the arm 25 at this length.

The brace 32 is disconnected from the connecting strips 33 of the mounting base 2 by removing the pins 35. The telescopic brace 32 is then shortened to its shortest length as illustrated in FIG. 4, and pivotted around the pin 34 to lie beside the lifting arm 25. In this position, the end of the brace 32 is received between the pair of connecting strips 31 as illustrated in FIG. 4.

The lifting arm 25 is then able to be pivotted downwardly to then lie vertically alongside the post 7. The brace 32 is positioned between the post 7 and lifting arm 25. A pin 41 is passed through a hole 42 at the lower end of the post 7 and through holes 43 located an the pair of connecting strips 31. The pin 41 ensures that the post 7, the brace 32 and the lifting arm 25 are secured together.

To complete the folding process, the lower pin 22 on the mounting bracket 21 is removed and the mounting bracket 21 is pivotted upwardly into the position illustrated in FIG. 3. The winch 20 is in the position adjacent the end of the lifting arm 25. The connecting member 8 is then removed from the base frame 5 by removing the pin 12. The crane 1 is now able to be removed from the motor vehicle and as the crane has a handle 45 located on the side of the post 7 it is able to be carried by hand.

The foregoing describes only one embodiment of the present invention, and modifications obvious to those skilled an the art can be made thereto without departing from the scope of the present invention.

I claim:

1. A crane (1) for a motor vehicle, the crane comprising:

a mounting base (2) for mounting to a tray of a motor vehicle rotatably about an axis of rotation;

an elongate base frame member (8) for attachment to said mounting base (2) and having a longitudinal axis extending substantially parallel to said tray when said base frame member (8) is attached to said mounting base (2) and said mounting base (2) is mounted to said tray, said base frame member (8) being pivotal about said axis of rotation of said mounting base (2);

a post (7) having one end for connection to said base frame member (8) and then extending substantially perpendicularly from said base frame member (8) at a position offset from said axis of rotation, said post (7) further having an opposite end;

a telescopic lifting arm (25) having first means for connection to said opposite end of said post (7) and pivotal movement in a plane defined by said longitudinal axis of said base frame member (8) and said post (7) when said base frame member (8) is connected to said post (7);

a telescopic brace (32) having second means at one end for connection to said lifting arm (25) and, when connected, pivotal movement from a position for use extending between said mounting base (2) and said lifting arm (25) to a folded position in which said telescopic brace (32) is disengaged from said mounting base (2) and pivots about said second means (31) to engage said first means (15), and said post (7), said brace (32) and said lifting arm (25) are substantially parallel.

2. The crane as claimed in claim 1, wherein said first and second means each comprise at least one connecting strip (15, 31).

3. The crane as claimed in claim 2, wherein said connecting strips (15, 31) are fixedly secured to said lifting arm (25) and respectively pivotally attached to said post (7) and said brace (32).

4. The crane as claimed in claim 2, wherein said first and second means further comprise pins (34, 18) respectively on said connection strips (15, 31) for said pivotal movements.

5. The crane as claimed in claim 1, and further comprising a winch (20) and rope (28) attached to said winch (20) and extending along said lifting arm (25).

6. The crane as claimed in claim 5, and further comprising a mounting bracket (21) attached to said winch (20) for mounting said winch (20) on said post (7).

7. The crane as claimed in claim 6, wherein said mounting bracket (21) comprises means for mounting said winch on said post (7) pivotally from a use position laterally of said post (7) to a folded position axial of said post (7).

8. The crane as claimed in claim 1, and further comprising a handle (45) on one of said post (7) and said lifting arm (25) for carrying.

* * * * *